US007384482B2

(12) United States Patent
Hosokawa

(10) Patent No.: US 7,384,482 B2
(45) Date of Patent: Jun. 10, 2008

(54) COATING TECHNIQUE

(75) Inventor: Ryuichi Hosokawa, Barrie (CA)

(73) Assignee: Honda of Canada Manufacturing, a division of Honda Canada Inc. (CA)

( * ) Notice: Subject to any disclaimer, the term of this patent is extended or adjusted under 35 U.S.C. 154(b) by 169 days.

(21) Appl. No.: 10/890,140

(22) Filed: Jul. 14, 2004

(65) Prior Publication Data

US 2004/0255850 A1 Dec. 23, 2004

Related U.S. Application Data

(62) Division of application No. 10/229,264, filed on Aug. 28, 2002, now Pat. No. 6,946,163.

(60) Provisional application No. 60/315,915, filed on Aug. 31, 2001.

(51) Int. Cl.
*B05C 13/00* (2006.01)

(52) U.S. Cl. ..... 118/63; 118/66

(58) Field of Classification Search ..... 118/63, 118/423, 58, 66, 699–704, 697, 677; 34/541, 34/666, 221; 15/316.1, 319
See application file for complete search history.

(56) References Cited

U.S. PATENT DOCUMENTS 2,896,335 A * 7/1959 Dungler ..... 34/68
4,535,936 A 8/1985 Fontaine ..... 239/117
4,771,552 A * 9/1988 Morioka ..... 34/222
5,254,166 A * 10/1993 Tu ..... 118/63
5,749,161 A * 5/1998 Jones ..... 34/541
5,786,036 A 7/1998 Pannenbecker et al. ..... 427/444
6,428,851 B1 * 8/2002 Friedersdorf et al. ..... 427/318

FOREIGN PATENT DOCUMENTS

JP 52-098748 8/1977
JP 9-103730 4/1997
JP 11-188303 7/1999

OTHER PUBLICATIONS

Patent Abstracts of Japan for JP 52-098748, published Aug. 18, 1977.

* cited by examiner

*Primary Examiner*—Brenda A. Lamb
(74) *Attorney, Agent, or Firm*—Katten Muchin Rosenman LLP

(57) ABSTRACT

Disclosed herein is a coating system for pre-coating a vehicle chassis, comprising a coating station and a curing oven, the coating station being upstream from said curing oven along a travel path, the coating station to deliver a layer of coating material thereon, the chassis having a number of sites, each of which is known to be source for accumulating excess coating to cause unwanted drips thereof during curing, further comprising a plurality of nozzles, each being in a nozzle group of one or more, where each group is arranged to deliver a flow of air sufficient to remove the excess coating.

18 Claims, 6 Drawing Sheets

COATING TECHNIQUE

This is a divisional application of application Ser. No. 10/229,264, filed Aug. 28, 2002 now U.S. Pat. No. 6,946,163, which claims priority from Appln. No. 60/315,915, filed Aug. 31, 2001, the contents of which are incorporated herein by reference.

REFERENCE TO CO-PENDING APPLICATIONS

The entire subject matter of U.S. Provisional application Ser. No. 60/315,915 filed Aug. 31, 2001 and entitled COATING TECHNIQUE is incorporated by reference. The applicant claims priority benefit under Title 35, United States Code, Section 119(e) of U.S. Provisional application Ser. No. 60/315,915 filed Aug. 31, 2001 and entitled COATING TECHNIQUE.

BACKGROUND OF THE INVENTION

1. Field of the Invention

The present invention relates to coating systems for articles such as vehicle chassis.

2. Description of the Related Art

In an automobile manufacturing plant vehicle chassis are commonly precoated using a coating tank. The coating fluid usually includes paint solids in a fluid carrier such as water. It is common for the vehicle chassis to leave the coating tank with coating fluid accumulated in and trickling down from the chassis' vertical panels.

The coated chassis are then usually directed through an oven along a travel path, during which the coating fluid will commonly flow out and cure as heat is applied. At the same time coating fluid continues to drain and to boil out from recessed areas such as hem flanges and seams leaving an impression of the trickles and drip on the surface of the painted body. As curing and baking of the paint progresses, the impression of any trickles and the built up drips becomes permanent. These drips must be sanded off before subsequent paint layers can be applied. The additional sanding step adds to the cost of painting, and accordingly the overall manufacturing costs of the automobile body.

Moreover, there is a loss in time and efficiency brought about by the need for a closer inspection of the painted surface, and the need for process control and further handling of the automobile body in order to correct flaws in the painted surface which have resulted from such drips.

A possible method for reducing drips would be to extend the drainage time before the coated bodies are transported into the oven, in order to allow more of the drips to naturally fall away from the vehicle bodies before they reach the curing ovens. In order to increase the drainage time on an automated manufacturing line it would be necessary to add additional conveyors to store and transport the bodies between the coating stage and the curing stage. The installation of additional conveyors would result in a large capital expenditure.

It is an object of the present invention to improve the coating process by removing the drips during curing or before curing or both.

SUMMARY OF THE INVENTION

In one of its aspects, the present invention provides a coating system for coating a vehicle chassis, comprising a coating station and a curing oven, the coating station being upstream from said curing oven along a travel path, the coating station to deliver a layer of coating material thereon, the chassis having a number of sites, each of which is known or determined to be source for accumulating excess coating to cause unwanted drips thereof during curing, further comprising a plurality of nozzles, each being in a nozzle group of one or more, where each group is arranged to deliver a flow of air sufficient to remove excess coating.

Preferably, each group is arranged to deliver a flow of air to a corresponding one of the sites, though more than one group can, if need be, be trained on the same site.

In one embodiment, a first nozzle group is upstream from a second nozzle group and the first and second nozzle groups sets are both located within the curing oven. Each of the first and second nozzle groups includes an upstream nozzle and a downstream nozzle, or more as needed. The first group of nozzles are positioned at a common elevation to direct the flow of air at an upper excess coating site on the chassis while the third group of nozzles are similarly positioned at a common elevation but to direct the flow of air at a lower excess coating site on the chassis. The first group of nozzles, in this embodiment, are staggered from the second group of nozzles. Preferably, a third group of nozzles is provided downstream from the first and second nozzle groups and is mounted on a pair of frame portions member extending upwardly from the conveyor path on opposite sides of the chassis, wherein the frame portions are formed on a frame section extending over or under the chassis or both Alternatively, the first and second nozzle groups may be at the same location relative to the travel path. Alternatively, one or more of the first and second nozzle groups sets may be located either within or outside (and upstream of) the curing oven In another of its aspects, there is provided a method of curing a coated vehicle chassis in a curing oven, comprising the steps of:

- delivering a plurality of coated vehicle chassis on a travel path through an oven;
- determining one or more excess coating sites on the chassis which are potential sources of excess coating which, if remaining following curing, will require remedial treatment before a subsequent painting step;
- providing a plurality of nozzles in nozzle groups of one or more along the travel path in the oven;
- directing each group of nozzles to a specific excess coating site on the vehicle chassis;
- delivering through each nozzle a flow of air sufficient to remove the excess coating from the excess coating site, and
- providing a sufficient number of nozzles so that excess coating has been removed from the excess coating sites on the vehicle chassis.

Preferably, the oven is a continuous oven but may also be provided in other forms, such as a batch processing oven.

In still another of its aspects, there is provided a coating system for coating an article, comprising a coating tank and a curing oven, the coating tank being upstream from said curing oven along a travel path, the coating tank for immersing the article to deliver a layer of coating material thereon, the article having a number of sites, each of which is known or determined to be source for accumulating excess coating to cause unwanted drips thereof during curing, further comprising a plurality of nozzles, each being in a nozzle group of one or more, where each group is arranged to deliver a flow of air sufficient to remove the excess coating.

In yet another of its aspects, there is provided a method of curing a coated article in a curing oven, comprising the steps of:

delivering a plurality of coated articles on a travel path through an oven;

determining one or more of the excess coating sites on the coated articles which are potential sources of excess coating which, if remaining following curing, will require remedial treatment before a subsequent painting step;

providing a plurality of nozzles in nozzle groups of one or more along the travel path in the oven;

training each group of nozzles on a specific excess coating site on the coated articles;

delivering through each nozzle a flow of air sufficient to remove the excess coating from the excess coating site, and providing a sufficient number of nozzles so that excess coating has been removed from the excess coating sites on the coated articles.

Preferably, the articles are delivered one by one along the travel path, but other arrangements are also contemplated, such as two-by two and the like, provided a sufficient number of nozzles are provided to contact the applicable surfaces of each article in need of treatment according to the present invention. For instance, there may be instances where the surfaces in need of treatment may exist on only one side, or the top, or the bottom, or a combination of one or more thereof.

Preferably, substantially all excess coating sites are determined and excess coating removed therefrom. However, there may be instances where not all of the excess coating sites need to be treated in this manner, such as, for example, those which are at a location behind a piece of molding, trim, a decal or some other covering.

BRIEF DESCRIPTION OF THE DRAWINGS

Several preferred embodiments of the present invention will be provided, by way of example only, with reference to the appended drawings, wherein.

DESCRIPTION OF THE PREFERRED EMBODIMENTS

Figure 2:
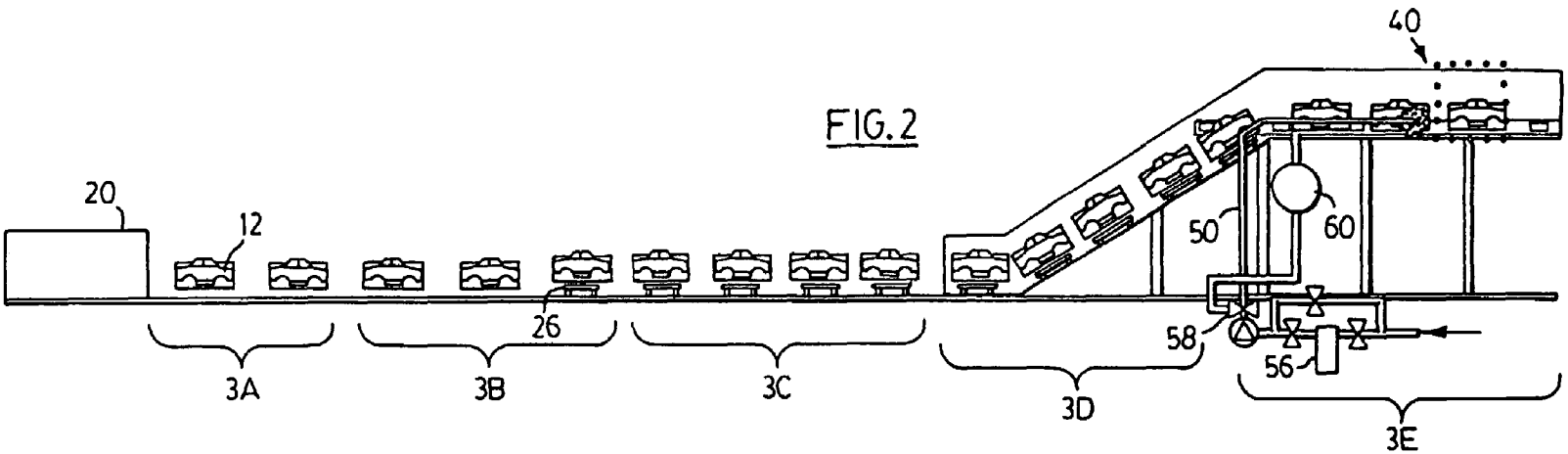
FIG. 2 is a schematic side view of the coating system of FIG. 1.
Figure 4A:
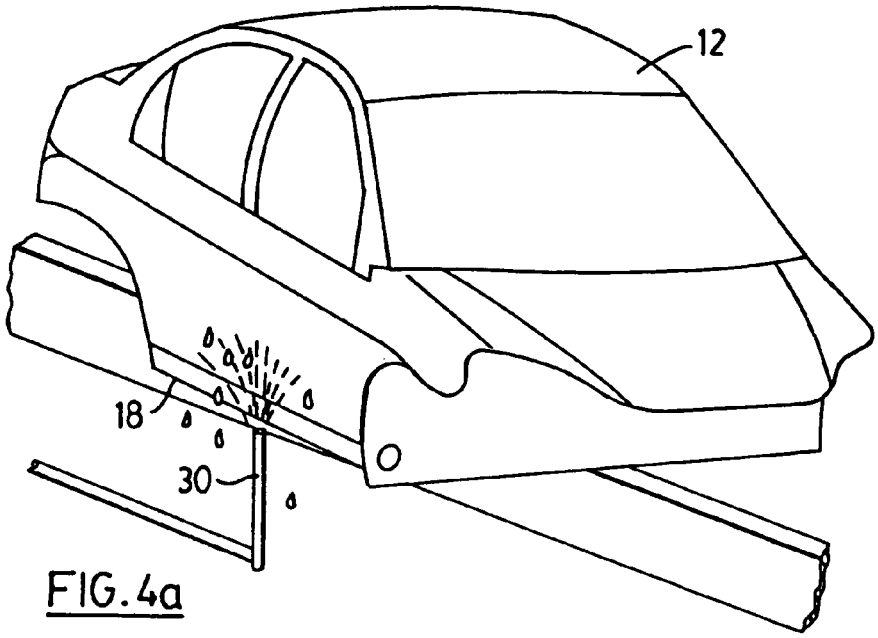
FIGS. 4*a*, 4*b* and 4*c* are, respectively, perspective, plan and front operational schematic views of one location in the coating system of FIG. 1.

Referring to the figures, there is provided a coating system shown at 10 for pre-coating a line of vehicle chassis or automobile bodies, one of which is shown at 12 in FIGS. 2 and 4*a*. The system 10 has a coating station or tank 20 for immersing the chassis 12 to deliver a layer of coating material thereon and a curing oven 22. The coating tank is upstream from the curing oven along a travel path 24 provided by a conveyor system 26 (as shown in FIG. 2).

The coating station has conventional equipment (not shown) for applying a coating material, such as a paint compound with a rust inhibitor, for example, by an "electro-coating" technique to incoming "white" automobile body parts. However, other coating techniques may also be used, if desired, to deliver the coating to the chassis.

FIG. 2 shows a number of views of the chassis 12 along the conveyor system. FIGS. 3*a* to 3*e* illustrate dripping sequences according to bracketed regions 3A to 3E in FIG. 2. The chassis has a number of sites, each of which is known or otherwise determined to be source for accumulating excess coating to cause unwanted drips or other flaws (shown at "D") thereof during curing.

The travel path 24 provides a primary drainage path to facilitate primary draining of excess paint or coating fluid. Paint fluid is the term given to the mixture of solid fine particulate paint, water, and permeate which is applied to the chassis body in the coating tank. As shown in FIGS. 3*a* to 3*e*, there is a significant amount of drainage of fluid along the primary drainage path. Most drainage occurs downwardly along vertical surfaces on the chassis and droplets of accumulated paint fluid can gather along the bottom surface 18 of the chassis, such as the bottom of the door as shown at 18 in FIGS. 3*a* to 3*e* and 4*a*.

Figure 4B:
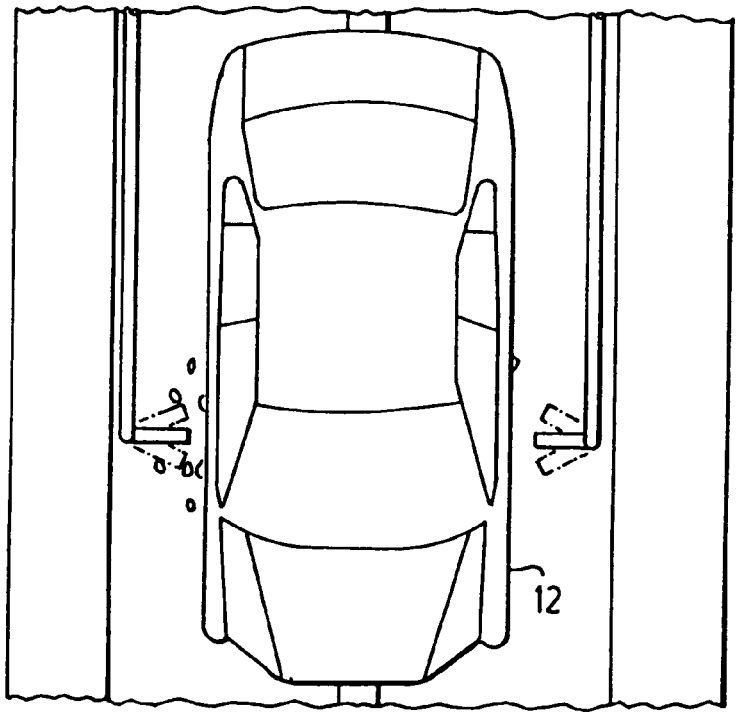
Figure 4C:
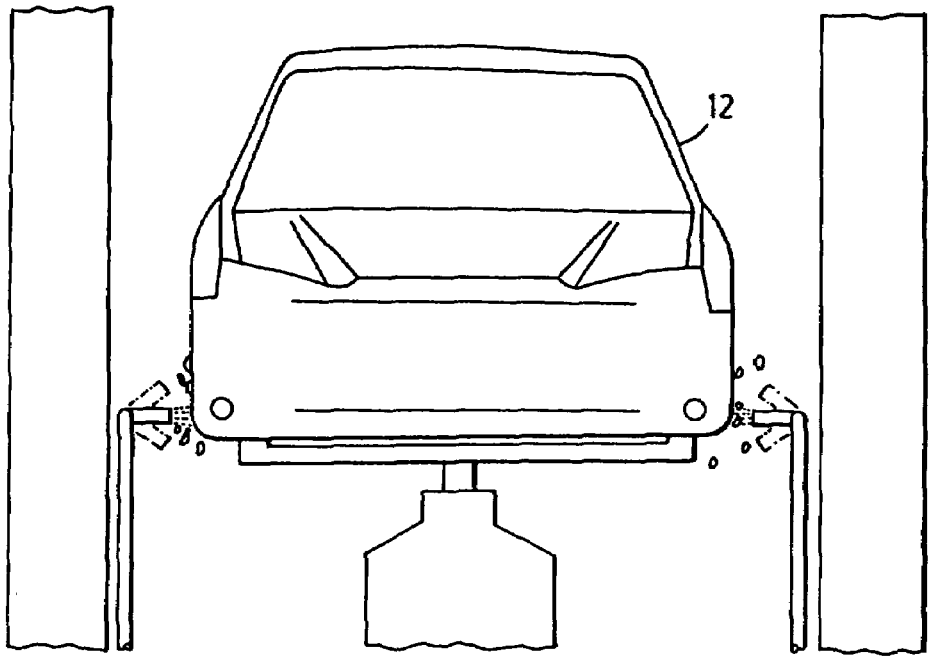

Referring to FIGS. 4*a* to 4*c*, the system 10 has a plurality of nozzles 30, each being in a nozzle group of one or more, where each group is arranged to deliver a flow (or a "blast") of air sufficient to remove the excess coating. The groups, for example, can be seen in FIG. 6, with one group identified as 32 and another group being identified at 34. Both groups are located in the curing oven and on the right hand side of the chassis as it progresses on from right to left along path 24 as viewed in FIG. 6. FIGS. 4*a* to 4*c* show two of the several possible arrangements available. FIG. 4*a* shows the nozzle pointing in an upward direction, while FIGS. 4*b* and 4*c* show the nozzle pointing in a horizontal direction. As can be seen in FIGS. 4*b* and 4*c*, the nozzles are adjustable so that their position can be adjusted with several degrees of freedom, in order that the identified excess coating sites on the vehicle chassis can be processed with a sufficient flow of air from a nozzle; that is at the proper outlet pressure, outlet proximity (that is a sufficient spacing between the excess coating site itself and the nozzle outlet) and outlet trajectory (the angle of the nozzle axis relative to the excess coating site). Thus, the angle of air flow, the distance from the nozzles to the chassis and the pressure of the air ejected from the nozzles may, if desirable, be made variable in order to maximize the blowing off or removal otherwise of the excess coating, while not disturbing the coated surface on the remainder of the chassis where drips or excess coating have not accumulated. The blast or flow of air may either be a short burst if the site is a discrete site, such as at a mounting tab or hole or the line, or may be of longer duration if the site extends along a region of an article, such as in this case the bottom of the door of the vehicle.

The figures show, for illustration purposes only, the paint or other coating being blown off the site. Though this may occur in some instances, it will be understood that the blast may be of a strength to distribute or spread out the collected material.

It can also be seen that the nozzle group 32 is above, and slightly staggered downstream from, nozzle group 34, though the staggered relationship is not necessary in all cases. In this case, both the first and second nozzle groups include an upstream nozzle and a downstream nozzle. Thus, the nozzles in nozzle group 32 are positioned at a common elevation to direct the flow of air at an upper excess coating site on the chassis and the nozzles of nozzle group 34 are positioned at a common elevation to direct the flow of air at a lower excess coating site on the chassis.

Figure 5:
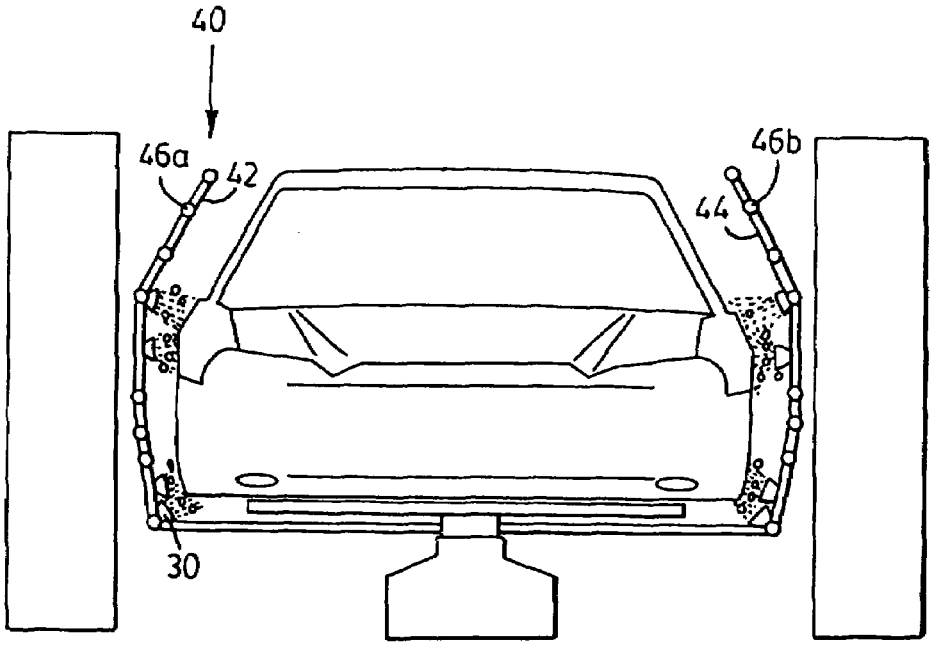
FIG. 5 is a front operational schematic view of another location in the coating system of FIG. 1.
Figure 6:
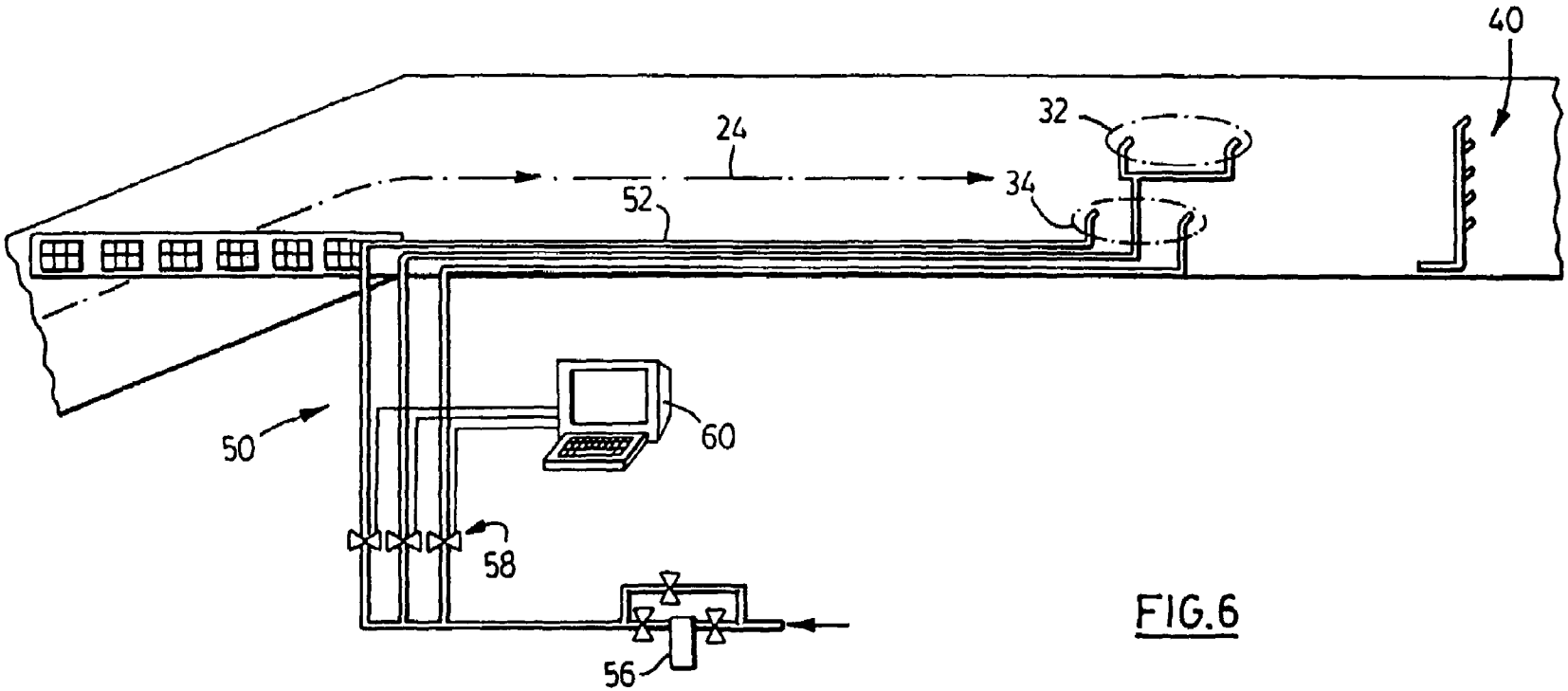
FIG. 6 is a layout view of another portion of the coating system of FIG. 1.

Another nozzle group is provided at 40 as best shown in FIG. 5. The right hand nozzle group is shown in FIG. 6. The nozzles of nozzle group 40 are located or mounted on a pair of frame portions 42, 44 extending upwardly from the conveyor path on opposite sides of the chassis. In this case, the frame portions 42, 44 are included in a frame section extending under the chassis. In this case, the frame portions provide a number of nozzle location sites, two of which are identified at 46*a*, 46*b*, for adding additional nozzles as desired, should additional excess coating sites be identified, or as a different vehicle chassis model is placed on the line.

Each of the nozzles is coupled to an air supply line shown generally at 50 in FIG. 6 which includes a number of air delivery hoses 52 to deliver the air, as needed, to each of the nozzles. The air supply line includes a filter regulator 56 for ensuring air quality and a valve controlled by a controller such as a PLC and/or a general purpose computer, the latter being shown at 60.

The general purpose computer may work within a network involving several general purpose computers, for example those sold under the trade names APPLE or IBM, or clones thereof, which are programmed with operating systems known by the trade names WINDOWS, LINUX or other well known or lesser known equivalents of these. The system involves pre-programmed software using a number of possible languages or a custom designed version of a programming software sold under the trade name ACCESS or similar programming software. The computer network may be a wired local area network, or a wide area network such as the Internet, or a combination of the two, without or without added security, authentication protocols, or under "peer-to-peer" or "client-server" or other networking architectures. The network may also be a wireless network or a combination of wired and wireless networks. The wireless network may operate under frequencies such as those dubbed 'radio frequency' or "RF" using protocols such as the 802.11, TCP/IP, BLUE TOOTH and the like, or other well known Internet, wireless, satellite or cell packet protocols. The system may, alternatively, be executed on a single custom built computer which is dedicated to the function of the system alone. The controller is thus capable, if desired, of timing the operation of each group of nozzles, which may be done group wise at the same time. Alternatively, one or more groups of nozzles may in fact have only one nozzle, with an independent air supply of air, under the control of the controller.

Figure 3A:
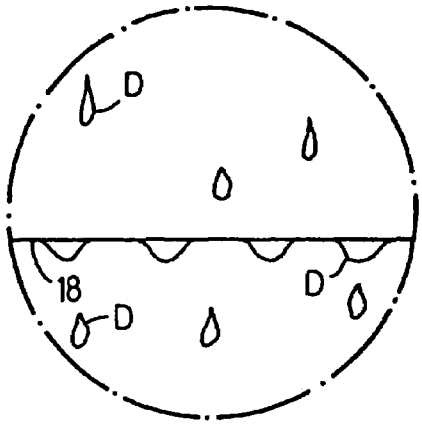
FIGS. 3*a* to 3*e* are sequential views of an article travelling along the coating system, each according to a corresponding one of arrows 3*a* to 3*e* in FIG. 2.
Figure 3B:
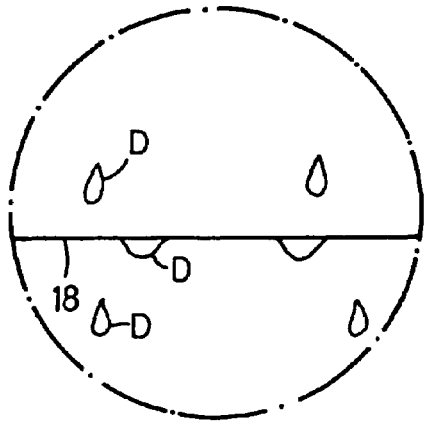
Figure 3C:
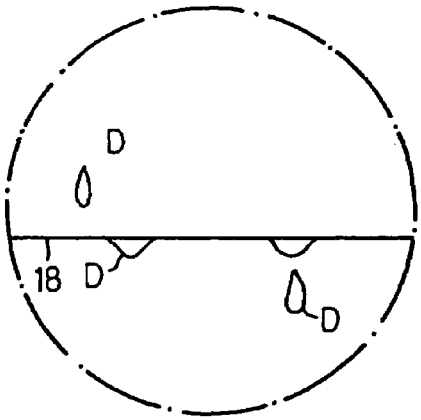
Figure 7:
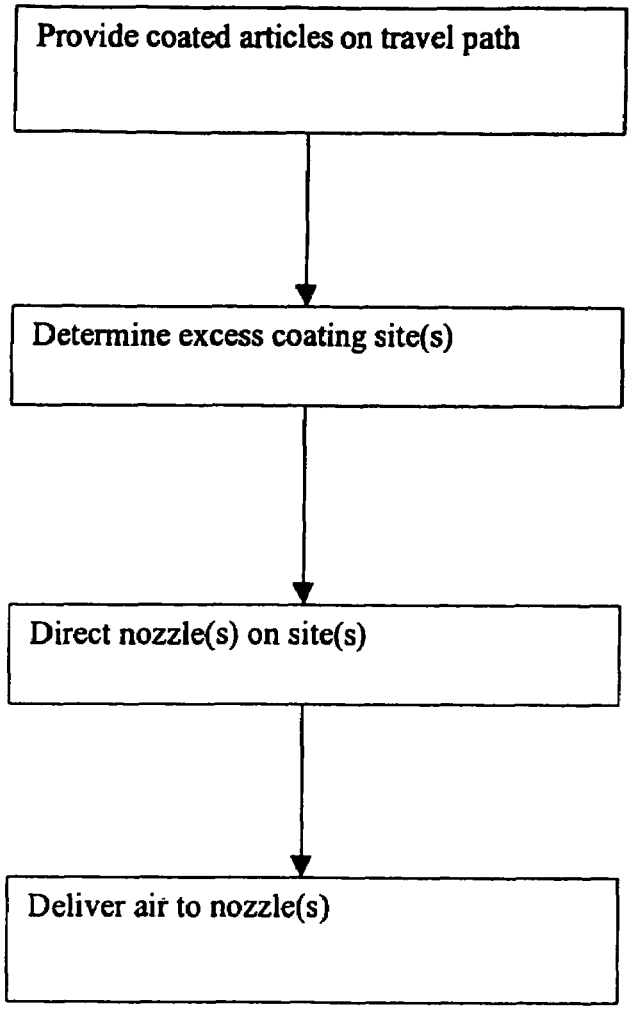
FIG. 7 is a schematic operational flow diagram of the coating system of FIG. 1.

Referring now to FIG. 7, the operation of the coating system is as follows. After the coated chassis emerges from the coating tank, it is conveyed by the conveyor toward the oven through the primary drainage path, to allow some time for coating material to leave the excess coating sites without assistance, such as from chassis components including the bottom of vehicle doors or sashes, as shown in FIGS. 3*a*, 3*b* and 3*c*. When the chassis has completed the preliminary drainage path, it reaches a conveyor transfer station where the chassis are transferred from a conveyor circulating through the coating station to a conveyor circulating through the oven.

Figure 3D:
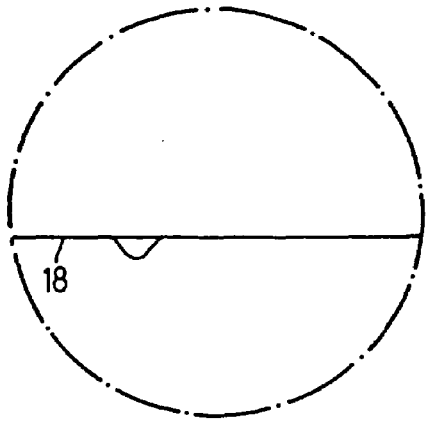
Figure 3E:
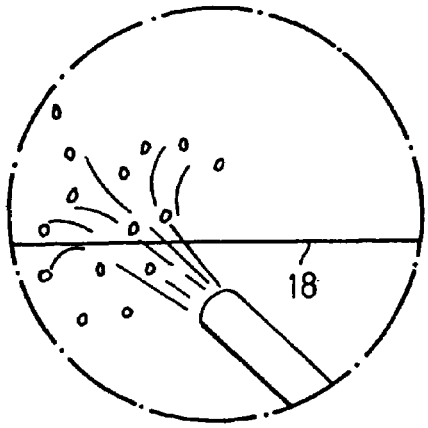

It is common, though not required, for the conveyor to be inclined on the approach to the oven, which is maintained at a higher level than the coating tank. During this stage, as shown at FIG. 3*d*, coating fluid droplets may, in some cases, continue to collect on the under surface of the chassis, as it is conveyed toward the oven.

Figure 1:
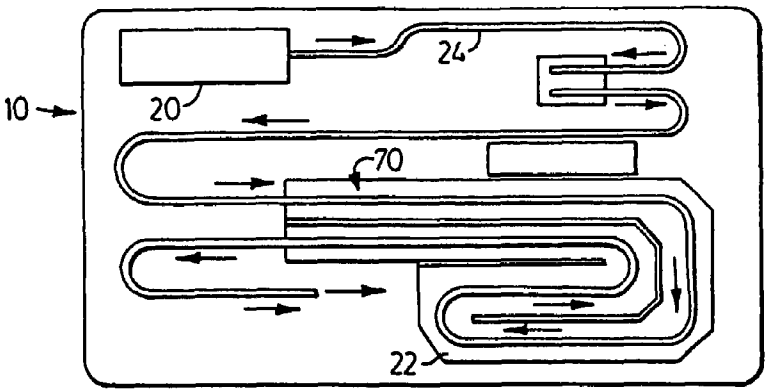
FIG. 1 is a schematic plan view of a coating system.

The chassis is then conveyed toward the oven while approaching a drying path 70 therein (as shown in FIG. 1). The length of the drying path is selected, having regard to the speed of the conveyor, the temperature maintained in the oven and the time needed to adequately cure the coating material.

As shown in the above figures, it is desirable in some cases to dispose the nozzles in a gantry or portal-like framework of a size large enough to permit passage therethrough of a vehicle chassis, while being conveyed through the oven. This framework advantageously facilitates the mounting of a plurality of nozzles or blow off units at positions around the body 12 to optimize the effectiveness of the pressurized air emitted by the nozzles for blowing off of the excess coating or droplets.

Preferably the air from the air supply is filtered prior to entering the nozzles or blow off units. The air pressure to the blow off units is preferably continuously adjustable and automatically controlled in order that the nozzles will deliver optimum air flow only when a chassis passes by the nozzles. On/Off regulation and air pressure are centrally controlled by the PLC and/or computer 60 to correspond to the speed of conveyor.

It is preferred to mount the nozzles in the oven to allow for longer draining time prior to blowing off and to allow for blowing of droplets of paint fluid which boil out of seams and overlaps in the metal as the coating material flows out and cures when heated in the oven 20. One or more additional downstream nozzle groups, such as those mounted on the frame members 42 and 44 may be useful, in some cases, to permit secondary removal of droplets or other excess coating from an excess coating site, such as that which may take longer to boil out of recessed areas such as hem flanges and seams.

Thus, it is believed that the coating system is useful to reduce or eliminate the negative effects of drips or other flaws as result of excess coating sites on a coated vehicle chassis prior to curing in an oven, all without extending the length of the assembly line or addition conveyors, while also removing the cost of remedial work to correct the flaws. In addition, while discussion hereinabove has been focused on vehicle chassis, the system may also be useful for other articles such as other vehicle parts. The coating station may coat in other ways, without necessarily immersing the chassis. Some additional air nozzles may be located, if desired, upstream of the oven. The coating system may be used either to provide a "pre-coat" for a later painting step or to provide a final coat of material.

While the present invention has been described for what are presently considered the preferred embodiments, the invention is not so limited. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

The invention claimed is:

1. A coating system for pre-coating a vehicle chassis, comprising:

a coating station and a curing oven, the coating station being disposed upstream from said curing oven along a travel path, the coating station being configured to deliver a layer of coating material to the chassis thereon, the chassis having a plurality number of sites, each site being a determined to be source for accumulating excess coating to cause unwanted drips thereof during curing, said system further comprising a plurality of nozzles, each nozzle being disposed in a nozzle group including of one or more nozzles, each nozzle group being trained on at least one specific excess coating site, wherein where each nozzle group is configured arranged to deliver a flow of air sufficient to remove the excess coating from a corresponding excess coating site without disturbing the layer of coating material on the chassis where drips and/or excess coating have not occurred, the nozzle groups including a first nozzle group upstream from a second nozzle group, a plurality of valves, each controlling the flow of air to one or more nozzles, a controller configured to control said plurality of valves and to time the operation of each nozzle group, the first and second nozzle groups being both located within the curing oven, wherein the first nozzle group includes an upstream nozzle and a downstream nozzle and the second nozzle group includes an upstream nozzle and a downstream nozzle, wherein the first nozzle group is positioned at a common elevation to direct the flow of air at an upper excess coating site on the chassis, and wherein the second nozzle group is positioned at a common elevation to direct the flow of air at a lower excess coating site on the chassis.

2. A system as defined in claim 1 wherein the first nozzle group is staggered from the second nozzle group.

3. A system as defined in claim 1, wherein the controller includes a PLC and/or a general purpose computer.

4. A coating system for coating an article, comprising:

a coating tank and a curing oven;

the coating tank being disposed upstream from said curing oven along a travel path;

the coating tank being configured for immersing the article to deliver a layer of coating material on the article, the article having a number of excess coating sites, each site being a source for excess coating to cause unwanted drips thereof during curing, said system further comprising a plurality of nozzles disposed in a plurality of nozzle groups, each nozzle group including one or more nozzles, each nozzle group being trained on at least one specific excess coating site on the article, wherein each nozzle group is configured to deliver a flow of air sufficient to remove the excess coating from a corresponding excess coating site without disturbing the layer of coating material on the article where drips and/or excess coating have not occurred, a plurality of valves, each controlling the flow of air to one or more nozzles, a controller configured to control said plurality of valves and to time the operation of each nozzle group; and wherein at least one nozzle group is mounted on a pair of frame portions extending upwardly from the travel path on opposite sides of the article.

5. A system as defined in claim 4, wherein the plurality of nozzle groups includes a first nozzle group which is disposed upstream from a second nozzle group.

6. A system as defined in claim 5, wherein the first and second nozzle groups are both disposed within the curing oven.

7. A system as defined in claim 5, wherein the first nozzle group includes an upstream nozzle and a downstream nozzle.

8. A system as defined in claim 7, wherein the second nozzle group includes an upstream nozzle and a downstream nozzle, wherein the first nozzle group are positioned at a common elevation to direct the flow of air at an upper excess coating site on the article, and wherein the second nozzle group are positioned at a common elevation to direct the flow of air at a lower excess coating site on the article.

9. A system as defined in claim 8, wherein the nozzles of the first nozzle group are staggered from the second nozzle group.

10. A system as defined in claim 7, further comprising a third nozzle group having an upstream nozzle and a downstream nozzle.

11. A system as defined in claim 4, wherein the frame portions are formed on a frame section extending over and/or under the article.

12. A system as defined in claim 4, wherein the controller includes a PLC and/or a general purpose computer.

13. A coating system for a vehicle chassis, comprising:

a coating station configured for delivering a coating to a surface of the vehicle chassis;

a curing oven;

a conveyor configured for conveying the vehicle chassis along a travel path from the coating station through the curing oven;

a plurality of nozzles disposed in a plurality of nozzle groups, each nozzle group comprising of one or more nozzles, each nozzle being positioned along the travel path;

each nozzle group being trained to a specific excess coating site on the vehicle chassis where excess coating accumulates and which, if remaining following curing, requires remedial treatment before painting;

an air supply configured for delivering through each nozzle a flow of air;

a plurality of valves, each controlling the flow of air to one or more nozzles; and a controller configured for controlling the flow of air through each nozzle according to the speed of the conveyor for removing excess coating from the corresponding excess coating site on the vehicle chassis without disturbing the coating on the chassis where drips and/or excess coating have not accumulated, the controller configured to control said plurality of valves and to time the operation of each nozzle group.

14. A system as defined in claim 13, wherein the nozzle groups include a first nozzle group and a second nozzle group, both of which are disposed within the curing oven.

15. A system as defined in claim 14, wherein the first nozzle group includes a first upstream nozzle and a first downstream nozzle, wherein the second nozzle group includes a second upstream nozzle and a second downstream nozzle, the first nozzle group being disposed at a first common elevation to direct the flow of air at an upper excess coating site on the chassis, the second nozzle group being disposed at a second common elevation to direct the flow of air at a lower excess coating site on the chassis.

16. A system as defined in claim 15, wherein the first nozzle group is staggered with respect to the second nozzle group.

17. A system as defined in claim 13, wherein at least one of said nozzle groups has an upstream nozzle and a downstream nozzle, each of the upstream nozzle and the downstream nozzle being mounted on a respective one of a pair of frame portions disposed on opposite sides of the chassis.

18. A system as defined in claim 13, wherein the controller includes a PLC and/or a general purpose computer.

* * * * *

UNITED STATES PATENT AND TRADEMARK OFFICE

CERTIFICATE OF CORRECTION

PATENT NO. : 7,384,482 B2
APPLICATION NO. : 10/890140
DATED : June 10, 2008
INVENTOR(S) : Ryuichi Hosokawa It is certified that error appears in the above-identified patent and that said Letters Patent is hereby corrected as shown below:

Column 6, line 65: "a plurality number of sites" should read -- a plurality of sites --.

Column 6, lines 65 - 66: "each site a determined to be" should read -- each site determined to be --.

Column 7, lines 2 - 3: "nozzle group including of one or more nozzles" should read -- nozzle group including one or more nozzles --.

Column 7, line 5: "nozzle group is configured arranged to" should read -- nozzle group is configured to --.

Column 8, line 23: "nozzle group comprising of one or more" should read -- nozzle group comprising one or more --.

Signed and Sealed this

First Day of June, 2010

David J. Kappos

David J. Kappos
*Director of the United States Patent and Trademark Office*